US010550837B2

(12) United States Patent
Yashiki et al.

(10) Patent No.: US 10,550,837 B2
(45) Date of Patent: Feb. 4, 2020

(54) PNEUMATIC SYSTEM OPERATION CONTROL DEVICE AND CONTROL METHOD

(71) Applicant: Hitachi Industrial Equipment Systems Co., Ltd., Chiyoda-ku, Tokyo (JP)

(72) Inventors: Tatsurou Yashiki, Tokyo (JP); Yaping Liu, Tokyo (JP); Yukinori Katagiri, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 21 days.

(21) Appl. No.: 16/064,868

(22) PCT Filed: Jul. 15, 2016

(86) PCT No.: PCT/JP2016/070926
§ 371 (c)(1),
(2) Date: Jun. 21, 2018

(87) PCT Pub. No.: WO2017/110120
PCT Pub. Date: Jun. 29, 2017

(65) Prior Publication Data

US 2018/0372086 A1 Dec. 27, 2018

(30) Foreign Application Priority Data

Dec. 25, 2015 (JP) ..... 2015-252808

(51) Int. Cl.
*F04B 49/06* (2006.01)
*F04B 49/08* (2006.01)
*F04B 49/10* (2006.01)

(52) U.S. Cl.
CPC ..... *F04B 49/06* (2013.01); *F04B 49/08* (2013.01); *F04B 49/106* (2013.01);
(Continued)

(58) Field of Classification Search
CPC ..... F04B 49/06; F04B 49/106; F04B 49/08; F04B 2205/09; F04B 2205/05;
(Continued)

(56) References Cited

U.S. PATENT DOCUMENTS

2001/0007337 A1* 7/2001 Buchholz ..... B64D 13/00 236/49.1
2008/0014097 A1 1/2008 Hase et al.
(Continued)

FOREIGN PATENT DOCUMENTS

CN 1755112 A 4/2006
CN 101105175 A 1/2008
(Continued)

OTHER PUBLICATIONS

Chinese-language Office Action issued in counterpart Chinese Application No. 201680058840.0 dated Dec. 27, 2018 with English translation (nine (9) pages).
(Continued)

*Primary Examiner* — Christopher E. Everett
(74) *Attorney, Agent, or Firm* — Crowell & Moring LLP

(57) ABSTRACT

A pneumatic system operation control device for variable control of the rotation speed of an electric motor for driving an air-compressor such that constantly supplied pressure to a terminal device is achieved in accordance with a discharge pressure measurement value of the air-compressor and a supply pressure measurement value to the terminal device. The control device: stores the discharge pressure measurement value and the supply pressure measurement value; and, upon receiving input of an air pipe network model composed of data for calculating a flow of air in an air pipe network, calculates a flow rate of air supplied to the terminal device and an update value of a control setting value, and updates
(Continued)

the control setting value to be used for variable control on the basis of the update value.

6 Claims, 12 Drawing Sheets

(52) U.S. Cl.
CPC ... *F04B 2203/0209* (2013.01); *F04B 2205/05* (2013.01); *F04B 2205/09* (2013.01); *F05B 2270/101* (2013.01); *F05B 2270/3013* (2013.01); *F05B 2270/327* (2013.01)

(58) Field of Classification Search
CPC ..... F04B 2203/0209; F04B 49/065; F04B 49/10; F04B 2207/02; F04B 2205/06; F05B 2270/327; F05B 2270/3013; F05B 2270/101
See application file for complete search history.

(56) References Cited

U.S. PATENT DOCUMENTS

2011/0036859 A1 2/2011 Matsuzaki et al.
2011/0223038 A1* 9/2011 Ogawa ..... F04B 49/06 417/45
2012/0029706 A1* 2/2012 Wagner ..... F04B 49/06 700/282
2013/0323088 A1* 12/2013 Medow ..... F15B 19/002 417/63
2016/0252091 A1* 9/2016 Wagner ..... F04C 28/02 702/35

FOREIGN PATENT DOCUMENTS

JP 2007-291870 A 11/2007
JP 2010-24845 A 2/2010
JP 2011-38479 A 2/2011

OTHER PUBLICATIONS

International Search Report (PCT/ISA/210) issued in PCT Application No. PCT/JP2016/070926 dated Sep. 27, 2016 with English-language translation (five (5) pages).
Japanese-language Written Opinion (PCT/ISA/237) issued in PCT Application No. PCT/JP2016/070926 dated Sep. 27, 2016 (four (4) pages).
Extended European Search Report issued in counterpart European Application No. 16878023.7 dated Jul. 11, 2019 (nine (9) pages).

* cited by examiner

PNEUMATIC SYSTEM OPERATION CONTROL DEVICE AND CONTROL METHOD

TECHNICAL FIELD

The present invention relates to a pneumatic system operation control device including an air compressor controlled by a variable speed device such as an inverter, and a control method thereof.

BACKGROUND ART

In recent years, in the trend of reduction in power consumption such as prevention of global warming and energy saving laws, production facilities are also required to reduce power consumption. Compressed air that is generated by compressing air in the atmosphere is widely used as a power source for driving a pneumatic tool, an air press, an air brake, a spray gun, and the like, because it gives users ready access. Hereafter, devices driven by compressed air are collectively referred to as terminal devices. The compressed air is compressed by an air compressor and supplied to the terminal device via a piping network provided in production facilities. It is said that power consumption of the air compressor accounts for 20 to 30% of the power consumption of an entire production facility, and it is necessary to reduce the power consumption of the air compressor in order to save energy at the production facility.

In order to reduce the power consumption of the air compressor, it is desirable to reduce discharge pressure of the air compressor as much as possible. On the other hand, in order to stably operate the terminal device, it is necessary to set the pressure of compressed air to be supplied to the terminal device to a desired pressure or more. A pressure loss of the piping network which supplies the compressed air compressed by the air compressor to the terminal device varies with the changes in the discharge air flow rate of the air compressor and the consumption air flow rate of the terminal device. Therefore, in general, the discharge pressure of the air compressor is set in anticipation of the maximum pressure loss of the piping network so that the supply pressure to the terminal device is equal to or higher than the desired pressure. As a result, compressed air having a pressure equal to or higher than a desired pressure can be supplied to the terminal device. However, in a case where the consumption air flow rate is small, since the discharge pressure of the air compressor is set high even though the pressure loss of the piping network is small, the air compressor is driven at a pressure which is more than necessary, and excess power is consumed.

In order to cope with this problem, Patent Literature 1 discloses an air compressor operation control device for supplying compressed air having a pressure equal to or higher than a desired pressure to a terminal device while reducing power consumption of the air compressor by variably controlling a rotational speed of an electric motor that drives an air compressor so that supply pressure to the terminal device and a discharge pressure of the air compressor are measured, and the supply pressure to the terminal device becomes equal to or higher than a desired pressure according to the consumption air flow rate at the terminal device.

In addition, Patent Literature 2 discloses a technique for determining operating conditions of an air compressor in which a record of a past operating condition of the air compressor is stored using a learning function, and the record of the past operating condition is referred to the current measurement values of the air compressor power consumption, an air compressor discharge pressure, and the supply pressure to the terminal device, whereby the technique can supply compressed air having a pressure equal to or higher than a desired pressure to the terminal device while reducing power consumption of the air compressor.

CITATION LIST

Patent Literature

PATENT LITERATURE 1: JP-A-2010-24845
PATENT LITERATURE 2: JP-A-2007-291870

SUMMARY OF INVENTION

Technical Problem

With the air compressor operation control device disclosed in Patent Literature 1, it is possible to supply compressed air having a pressure equal to or higher than a desired pressure to the terminal device while reducing power consumption of the air compressor. On the other hand, due to the influence of the volume of the piping constituting the piping network, the supply pressure to the terminal device varies with a delay with respect to a change in the discharge pressure of the air compressor, and the delay time is about several tens of seconds. Since the supply pressure to the terminal device responds with a delay to the air compressor discharge pressure, the supply pressure to the terminal device generally fluctuates in a case where the air compressor is controlled so that the supply pressure to the terminal device is a constant pressure. In view of this, the air compressor operation control device disclosed in Patent Literature 1 controls the rotational speed of the electric motor driving the air compressor by the PID control so as to suppress fluctuations in the supply pressure. However, the volume of the piping differs depending on the condition of a piping layout in which the air compressor is installed, and even after installation the piping layout changes due to the additionally installed terminal devices and the like. That is, in the air compressor operation control device disclosed in Patent Literature 1, it is difficult to adjust the control set value according to the installation state of the piping layout, and the supply pressure may fluctuate.

In addition, with the technique disclosed in Patent Literature 2, it is possible to supply compressed air having a pressure equal to or higher than a desired pressure to the terminal device while reducing power consumption of the air compressor. However, with the technique disclosed in Patent Literature 2, it is indispensable for users to input the operating condition of the air compressor in advance. In addition, in a case where the piping layout is changed, there is a problem that it is necessary for users to initialize the record of the past operating condition which has been learned, and input the operating condition of the air compressor again.

It is an object of the present invention to provide an air compressor operation control device which supplies compressed air having a pressure equal to or higher than a desired pressure to the terminal device while suppressing fluctuations of the supply pressure to the terminal device, and reducing the power consumption of the air compressor according to the installation state of the piping layout without the need for users to input the operating condition of the air compressor in advance.

Solution to Problem

In order to achieve the above object, the present invention provides a pneumatic system operation control device that variably controls a rotational speed of an electric motor for driving an air compressor so that a supply pressure to a terminal device becomes constant using a measurement value of a discharge pressure of the air compressor and a measurement value of the supply pressure to the terminal device. The pneumatic system operation control device includes a measurement value storage unit that stores the discharge pressure measurement value and the supply pressure measurement value, an air piping network model input unit that receives an air piping network model composed of data for calculating air flow in an air piping network, the air piping network being a path for supplying compressed air from the air compressor to the terminal device, an air piping network model storage unit that stores the air piping network model, a terminal device flow rate calculation unit that calculates an air flow rate supplied to the terminal device using the discharge pressure measurement value, the supply pressure measurement value, and the air piping network model, a terminal device flow rate storage unit for storing the air flow rate, a control set value calculation unit for calculating an updating value for a control set value using the control set value for variably controlling the rotational speed of the electric motor for driving the air compressor, the air flow rate, and the air piping network model, a control set value storage unit for storing the updating value, and a control set value updating command value generation unit that generates the command value for updating a control set value for variably controlling the rotational speed of the electric motor for driving the air compressor using the updating value.

Advantageous Effects of Invention

According to the present invention, it is possible to supply compressed air having a pressure equal to or higher than a desired pressure to the terminal device while suppressing fluctuations in the supply pressure to the terminal device, and reducing the power consumption of the air compressor according to the installation state of the piping layout without the need for users to input the operating condition of the air compressor in advance.

DESCRIPTION OF EMBODIMENTS

Embodiments of the present invention will be described below with reference to the drawings.

First Embodiment

Figure 1:
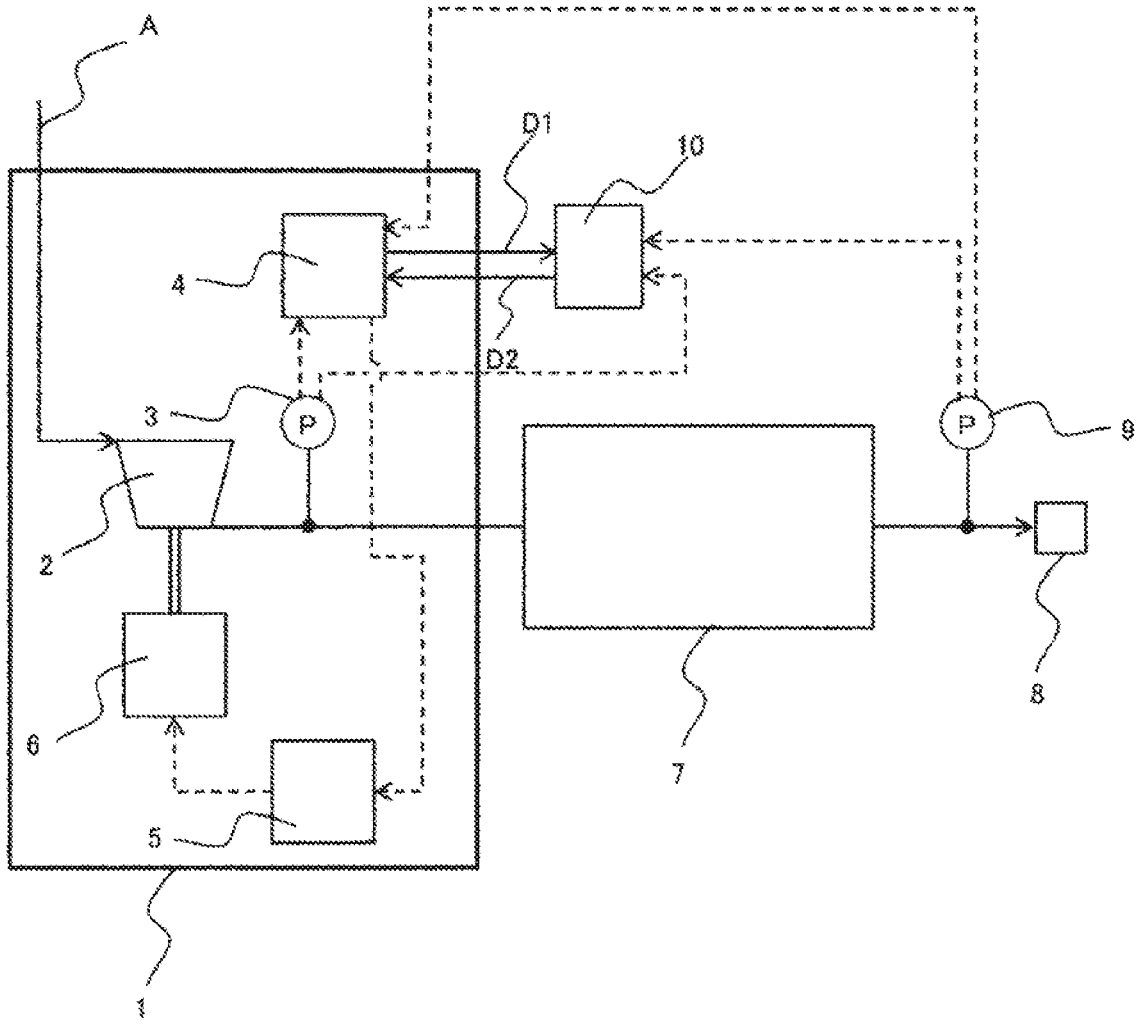
FIG. 1 is a schematic configuration view of a pneumatic system operation control device according to a first embodiment.

FIG. 1 is a schematic configuration view of a pneumatic system operation control device according to a first embodiment.

The pneumatic system operation control device shown in FIG. 1 includes an air compressor unit 1, an air piping network 7, a terminal device 8, a terminal device pressure sensor 9, and a control set value updating unit 10.

The air compressor unit 1 compresses air A sucked from the atmosphere to discharge the compressed air. The air compressor unit 1 includes an air compressor main body 2, an air compressor discharge portion pressure sensor 3, a control device 4, a variable speed device 5, and an electric motor 6. Hereinafter, a schematic configuration of the air compressor unit 1 will be described.

The air compressor main body 2 sucks and compresses the air A.

The air compressor discharge portion pressure sensor 3 measures the pressure of the compressor air discharged from the air compressor main body 2. The measured pressure value is output to the control device 4 and the control set value updating unit 10.

The control device 4 receives the pressure measurement value of the air compressor discharge portion pressure sensor 3 and the pressure measurement value of the terminal device pressure sensor 9, controls the rotational speed of the electric motor 6 so that the supply pressure of the compressor air to the terminal device 8 becomes equal to or higher than a required pressure P0, and calculates and outputs the rotational speed command value for the electric motor 6. A specific calculation method for controlling the rotational speed of the electric motor 6 is described in, for example, Patent Literature 1 "JP-A-2010-24845". In addition, the control device 4 outputs the current value of a control set value D1 for controlling the rotational speed of the electric motor 6 to the control set value updating unit 10, and also updates the current value D1 of the control set value on the basis of a control set value updating command value D2 which is output by the control set value updating unit 10.

The variable speed device 5 receives the rotational speed command value, and outputs the electric power necessary for rotating the electric motor 6 at the designated rotational speed.

The electric motor 6 is coupled to the air compressor main body 2 via a rotating shaft, and rotates according to the input electric power to drive the air compressor main body 2.

The schematic configuration of the air compressor unit 1 has been described in the above.

The air piping network 7 includes an air layer, a filter, a drier, a pipe, an elbow, a branch, a valve, and the like. Compressed air discharged from the air compressor unit 1 is supplied to the terminal device 8 via the air piping network 7.

The terminal device 8 is a device such as a pneumatic tool, an air press, an air brake, a spray gun, and the like, which are used in a manufacturing process in a production facility, and is driven by the compressed air, as a power source, supplied via the air piping network 7.

The terminal device pressure sensor 9 measures the pressure of the compressor air supplied to the terminal device 8. The measured pressure value is output to the control device 4 and the control set value updating unit 10.

The control set value updating unit 10 receives the pressure measurement value of the air compressor discharge portion pressure sensor 3 and the pressure measurement value of the terminal device pressure sensor 9, and outputs the control set value updating command value. The control device 4 receives the above-mentioned control set value updating command value, and updates the control set value.

Figure 2:
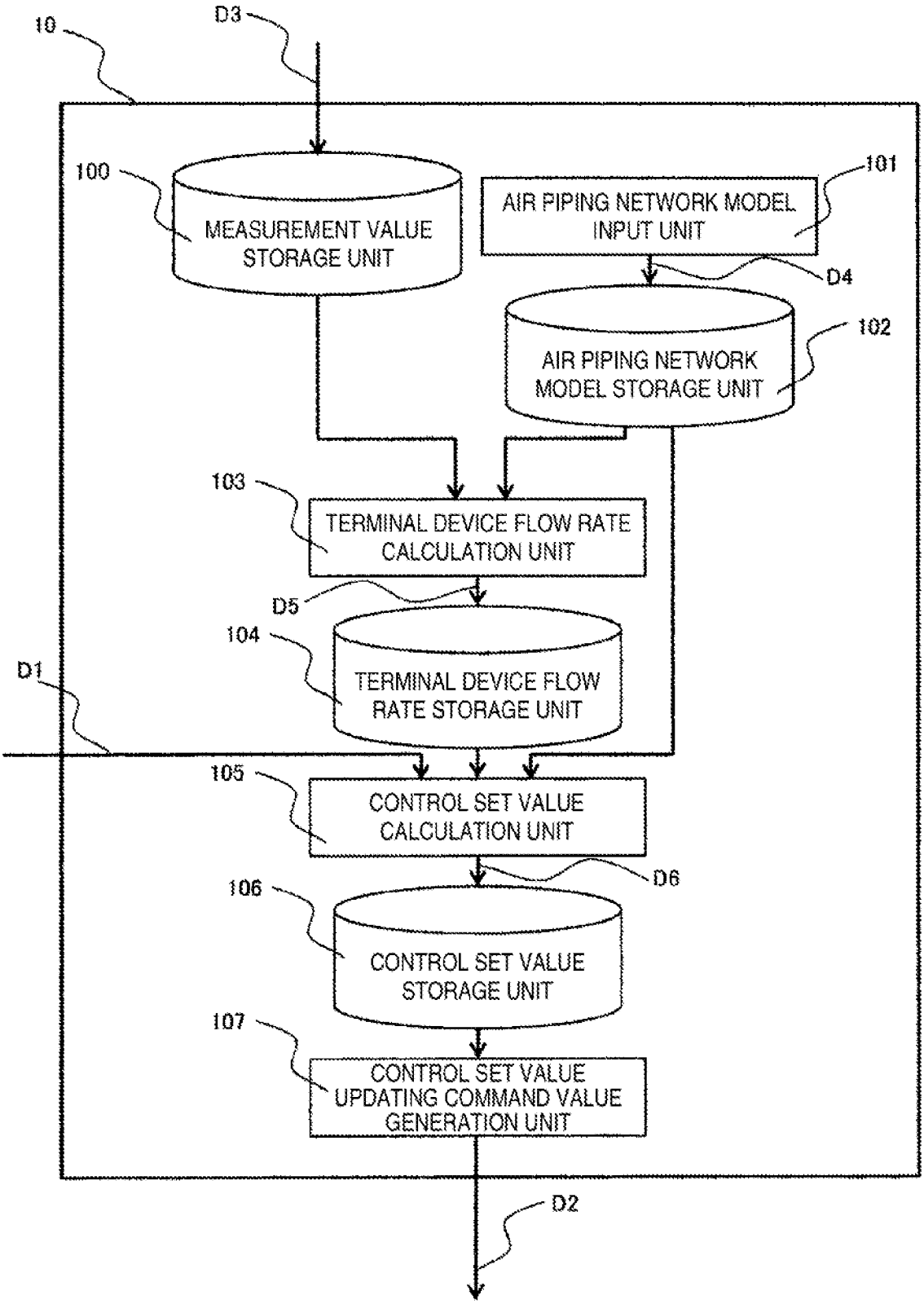
FIG. 2 is a schematic configuration view of a control set value updating unit according to the first embodiment.

Hereinafter, the details of the control set value updating unit 10 will be described with reference to FIG. 2. The control set value updating unit 10 includes a measurement value storage unit 100, an air piping network model input unit 101, an air piping network model storage unit 102, a terminal device flow rate calculation unit 103, a terminal device flow rate storage unit 104, a control set value calculation unit 105, a control set value storage unit 106, and a control set value updating command value generation unit 107.

The measurement value storage unit 100 includes a memory and a hard disk, and stores a pressure measurement value D3 acquired by the air compressor discharge portion pressure sensor 3 and the terminal device pressure sensor 9.

The air piping network model input unit 101 receives data necessary for calculating the flow of the compressed air in the air piping network 7, and outputs an air piping network model D4. More specifically, the air piping network model D4 includes data defining the connection relationship between the equipment constituting the air piping network 7, data defining the attributes (for example, piping length, piping diameter, etc. for the piping) of the appliances, and data for calculating the discharge air pressure of the air compressor unit 1.

The air piping network model storage unit 102 includes a memory and a hard disk, and stores the air piping network model D4 output by the air piping network model input unit 101.

The terminal device flow rate calculation unit 103 calculates the air flow in the air piping network 7 using the pressure measurement value D3 and the air piping network model D4, and outputs a terminal device flow rate D5 which is a compressed air flow rate supplied to the terminal device. A specific calculation method for calculating the air flow in the air piping network 7 is described in, for example, the document, "GP. Greyvenstein (2002), An implicit method for the analysis of transient flows in pipe networks, International Journal for Numerical Methods in Engineering, vol. 53, issue 5, pp. 1127-1143".

The terminal device flow rate storage unit 104 includes a memory and a hard disk, and stores the terminal device flow rate D5 output by the terminal device flow rate calculation unit 103.

The control set value calculation unit 105 calculates the control set value using the control set value D1, the air piping network model D4, and the terminal device flow rate D5 so as to suppress the fluctuations in the supply pressure to the terminal device, and output it as a control set value updating value D6. A specific method of calculating the control set value updating value D6 will be described later with reference to FIGS. 6, 7, and 8.

The control set value storage unit 106 includes a memory and a hard disk, and stores the control set value updating value D6 output by the control set value calculation unit 105.

The control set value updating command value generation unit 107 receives the control set value updating value D6, and outputs the control set value updating command value D2 for updating the control set value D1 of the control device 4.

Figure 3:
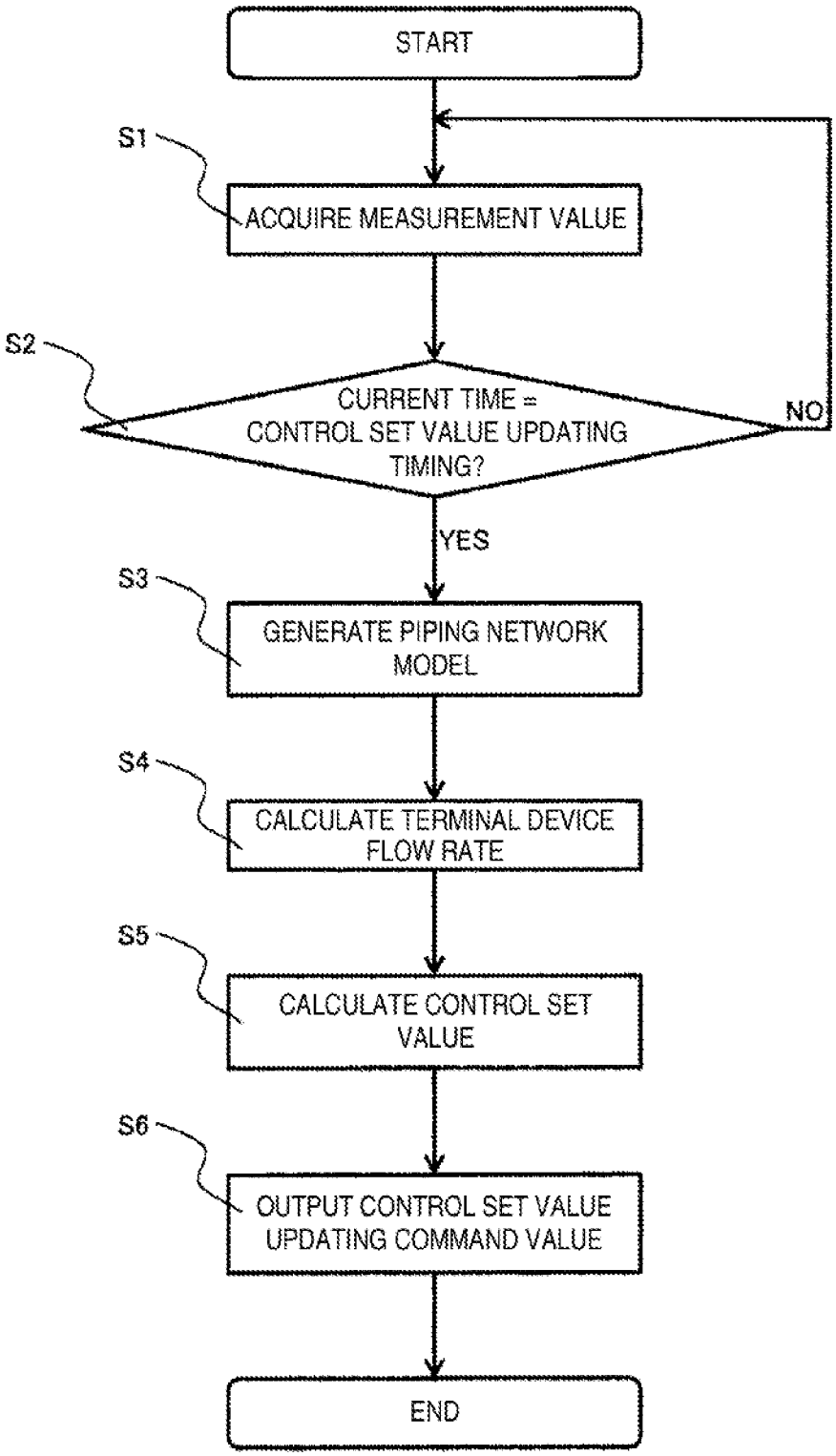
FIG. 3 is a flowchart of processing procedure for updating a control set value in the pneumatic system operation control device according to the first embodiment.

The configuration of the pneumatic system operation control device has been described in the above. Next, the content of the process performed by the control set value updating unit 10 will be described in detail. FIG. 3 shows a processing procedure for updating a control set value in the pneumatic system operation control device according to the first embodiment.

In step S1 (measurement value acquisition process), the measurement value storage unit 100 includes a memory and a hard disk, and stores the pressure measurement value D3 acquired by the air compressor discharge portion pressure sensor 3 and the terminal device pressure sensor 9.

Figure 4A:
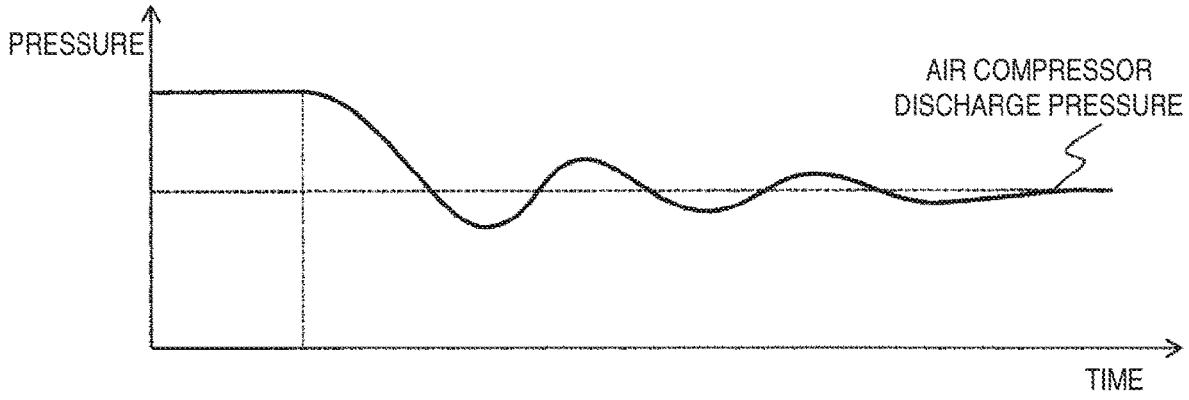
FIG. 4A shows time series data of the compressed air pressure at the air compressor discharge portion and the compressed air pressure supplied to the terminal device according to the first embodiment.
Figure 4B:
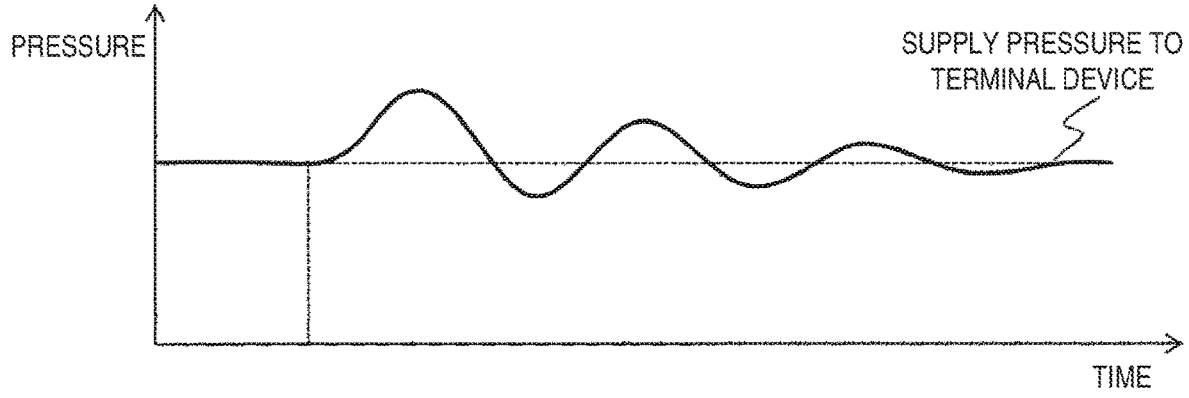
FIG. 4B shows time series data of the compressed air pressure at the air compressor discharge portion and the compressed air pressure supplied to the terminal device according to the first embodiment.

In step S2 (control set value timing determination process), the control set value updating unit 10 determines whether the current time coincides with a update timing of a preset control set value. If the determination result is Yes, the process proceeds to step S3 (piping network model generation process), and if No, the process of step S1 is continued. In the processes of steps S1 and S2, time series data of the compressed air pressure at the air compressor discharge portion and the compressed air pressure supplied to the terminal device 8, which are shown in FIG. 4, is acquired.

In step S3 (piping network model generation process), the air piping network model input unit 101 receives data necessary for calculating the flow of the compressed air in the air piping network 7, and outputs the air piping network model D4. The air piping network model D4 is stored in the memory and the hard disk of the air piping network model storage unit 102.

Figure 5:
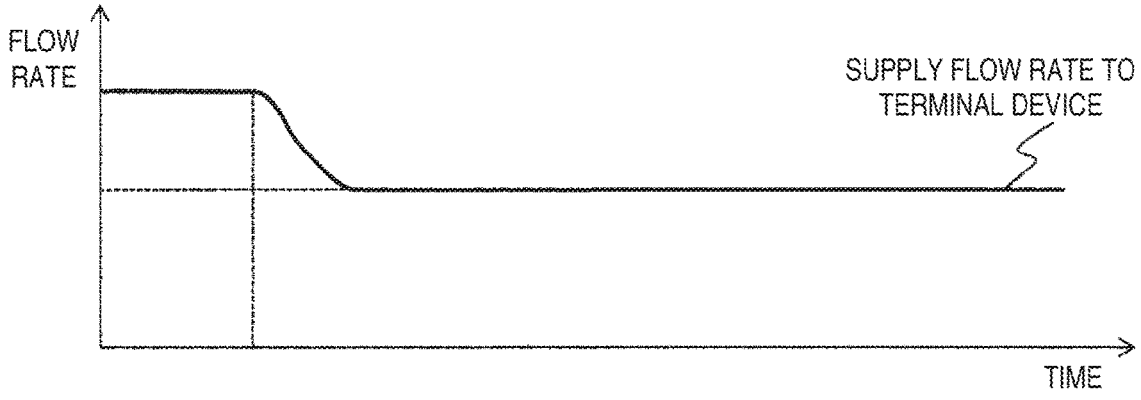
FIG. 5 shows a calculation value of the compressed air flow rate supplied to the terminal device according to the first embodiment.

In step S4 (terminal device flow rate calculation process), the terminal device flow rate calculation unit 103 calculates the air flow in the air piping network 7 using the pressure measurement value D3 and the air piping network model D4, and outputs the terminal device flow rate D5 which is the compressed air flow rate supplied to the terminal device. FIG. 5 shows an example of the terminal device flow rate D5 output by the terminal device flow rate calculation unit 103 with respect to time series data of the compressed air pressure at the air compressor discharge portion and the compressed air pressure supplied to the terminal device 8, which are shown in FIG. 4. The terminal device flow rate D5 is stored in the memory and the hard disk of the terminal device flow rate storage unit 104.

In step S5 (control set value calculation process), the control set value calculation unit 105 calculates the control set value updating value D6 using the control set value D1, the air piping network model D4, and the terminal device flow rate D5 so as to suppress the fluctuations in the supply pressure to the terminal device. Details of the process of step S5 will be described later with reference to FIGS. 6, 7, and 8. The control set value updating value D6 is stored in the memory and the hard disk of the control set value storage unit 106.

In step S6 (control set value updating command value output process), the control set value updating command value generation unit 107 receives the control set value updating value D6, and outputs the control set value updating command value D2 for updating the control set value D1 of the control device 4.

Figure 6:
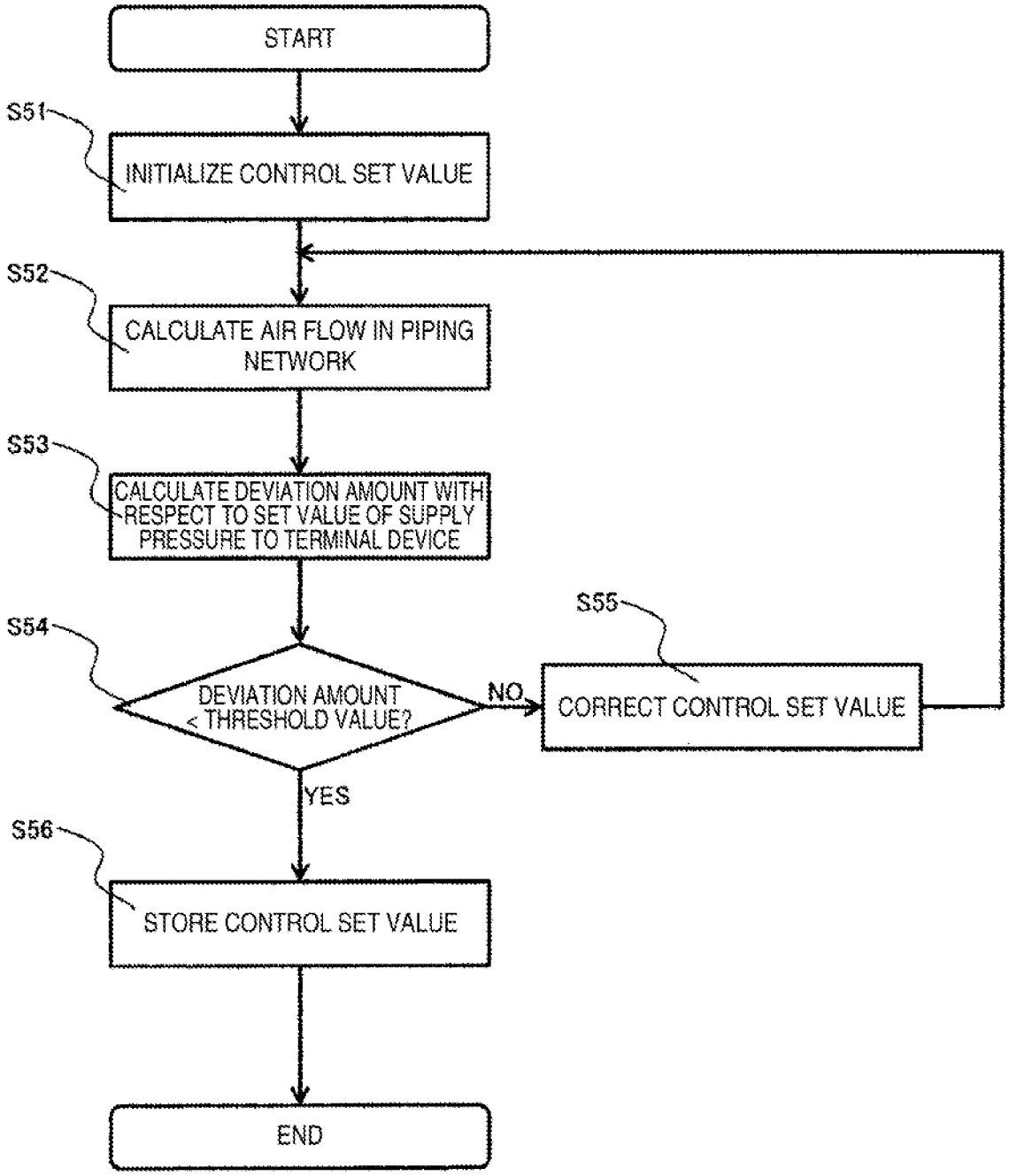
FIG. 6 is a detailed flowchart of a control set value calculation process according to the first embodiment.
Figure 7:
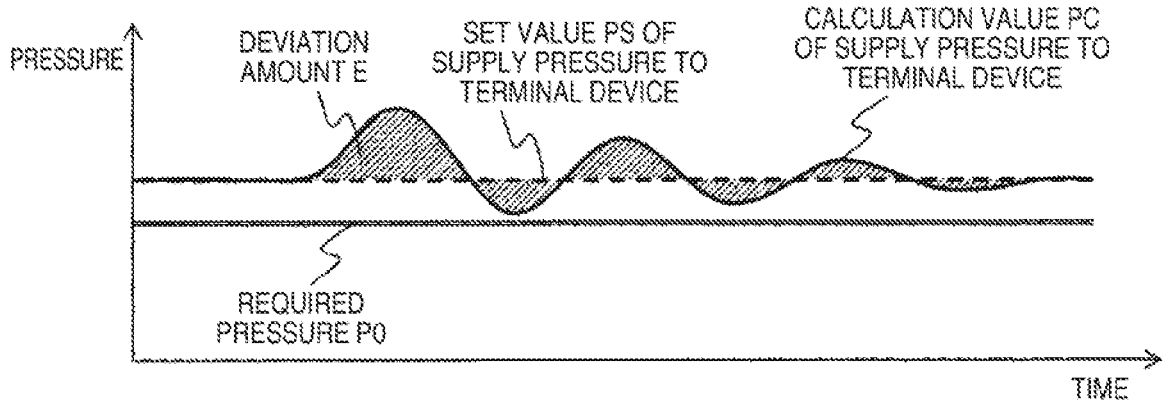
FIG. 7 is a diagram showing the relations between a set value of a supply pressure to the terminal device, a calculation value of a supply pressure to the terminal device, a required pressure, and a deviation amount according to the first embodiment.

Next, details of the processing in step S5 (control set value calculation process) will be described with reference to FIGS. 6, 7, and 8. As shown in FIG. 6, step S5 includes six processing steps from step S51 to step S56.

In step S51 (control set value initialization process), the control set value calculation unit 105 substitutes the control set value D1 for the control set value updating value D6 and initializes it. For example, in a case where the control device 4 controls the rotational speed of the electric motor 6 by a PID control, the control set value D1 is three parameters which are a proportional gain KP, an integration time TI, and a differentiation time TD, and the current values of the three parameters are substituted for the control set value updating value D6.

In step S52 (piping network air flow calculation process), the control set value calculation unit 105 calculates the air flow in the air piping network 7 using the air piping network model D4, the terminal device flow rate D5, and the control set value updating value D6, and outputs a calculation value PC of the supply pressure to the terminal device which is the compressed air pressure supplied to the terminal device 8.

In step S53 (pressure deviation amount calculation process), the control set value calculation unit 105 calculates the deviation amount E of the calculation value PC of the supply pressure to the terminal device with respect to a set value PS of the supply pressure to the terminal device as an index for evaluating the amount of the fluctuations in the supply pressure to the terminal device 8. Here, the deviation amount E corresponds to diagonally shaded areas in FIG. 7, and is calculated from the following expression.

$$E=\int|PC-PS|dt \quad \text{(Equation 1)}$$

In addition, the set value PS of the supply pressure to the terminal device is set so that supply pressure to the terminal device becomes equal to or higher than the required pressure P0 by controlling the rotational speed of the electric motor 6 in the control device 4. Due to the influence of the volume of piping constituting the air piping network 7, the supply pressure to the terminal device responds with a delay to the air compressor discharge pressure. Therefore, in a case where the air compressor is controlled so that the supply pressure to the terminal device becomes a constant pressure, the supply pressure to the terminal device fluctuates. Therefore, as shown in FIG. 7, the set value PS of the supply pressure to the terminal device is set higher than the required pressure P0.

In step S54 (control set value updating process end determination process), the control set value calculation unit 105 determines whether the deviation amount E is greater than the threshold value. If the determination result is Yes, the process proceeds to step S56 (control set value storing process), and if No, the process proceeds to step S55 (control set value correction process).

In step S55 (control set value correction process), the control set value calculation unit 105 corrects the control set value updating value D6 so that the deviation amount E decreases. For example, a genetic algorithm method, which is a known optimization algorithm, an annealing method, or the like can be applied to a specific calculation method for correcting the control set value updating value D6.

In step S56 (control set value storage process), the control set value calculation unit 105 outputs the control set value updating value D6, which is stored in the memory and the hard disk of the control set value storage unit 106.

Figure 8:
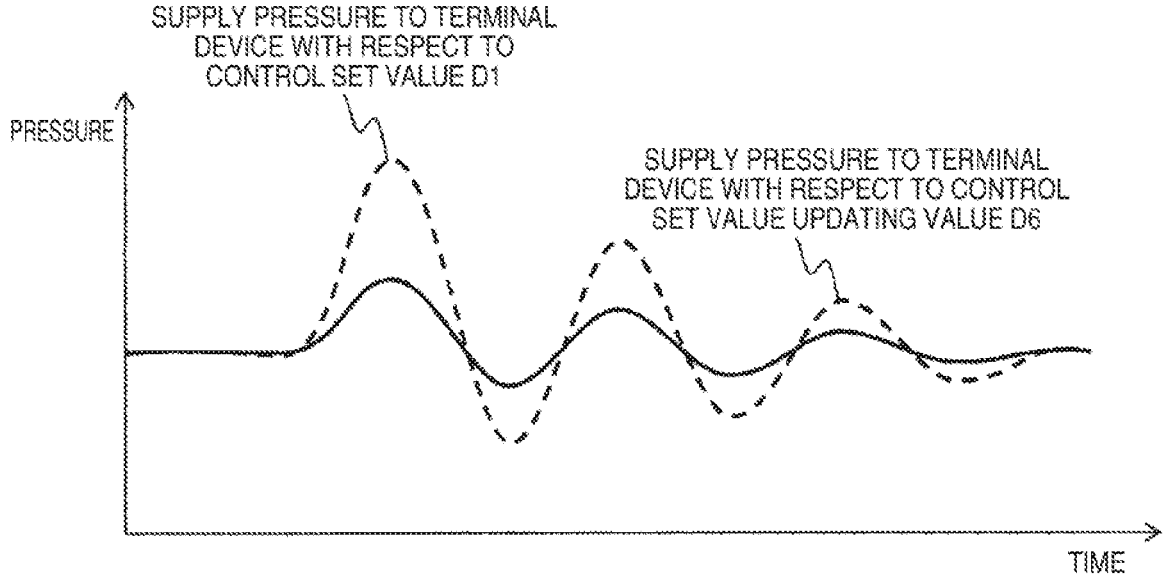
FIG. 8 is a diagram in which a supply pressure to the terminal device with respect to the control set value and a supply pressure to the terminal device with respect to a control set value updating value according to the first embodiment are compared.

FIG. 8 is a diagram in which the supply pressure to the terminal device with respect to the control set value D1 and the supply pressure to the terminal device with respect to the control set value updating value D6 are compared. Since the control set value calculation unit 105 corrects the control set value updating value D6 so that the deviation amount E of the calculation value PC of the supply pressure to the terminal device with respect to the set value PS of the supply pressure to the terminal device is equal to or less than the threshold value, the amount of the fluctuations in the supply pressure to the terminal device with respect to the control set value updating value D6 is smaller than the amount of the fluctuations in the supply pressure to the terminal device with respect to the control set value D1.

The detailed description of the process of step S5 has been made in the above.

In the embodiment, the control set value D1 for controlling the rotational speed of the electric motor 6 in the control device 4 is updated so that in accordance with the processing procedure for updating the control set value shown in FIGS. 3 and 6, the fluctuations in the supply pressure to the terminal device is small according to the installation state of a piping layout. In addition, users are not required to enter the operating condition of the air compressor in advance.

As described above, in the present embodiment, it is possible to supply compressed air having a pressure equal to or higher than a desired pressure to the terminal device while suppressing the fluctuations in the supply pressure to the terminal device, and reducing the power consumption of the air compressor according to the installation state of the piping layout without the need for users to input the operating condition of the air compressor in advance.

Second Embodiment

Figure 9:
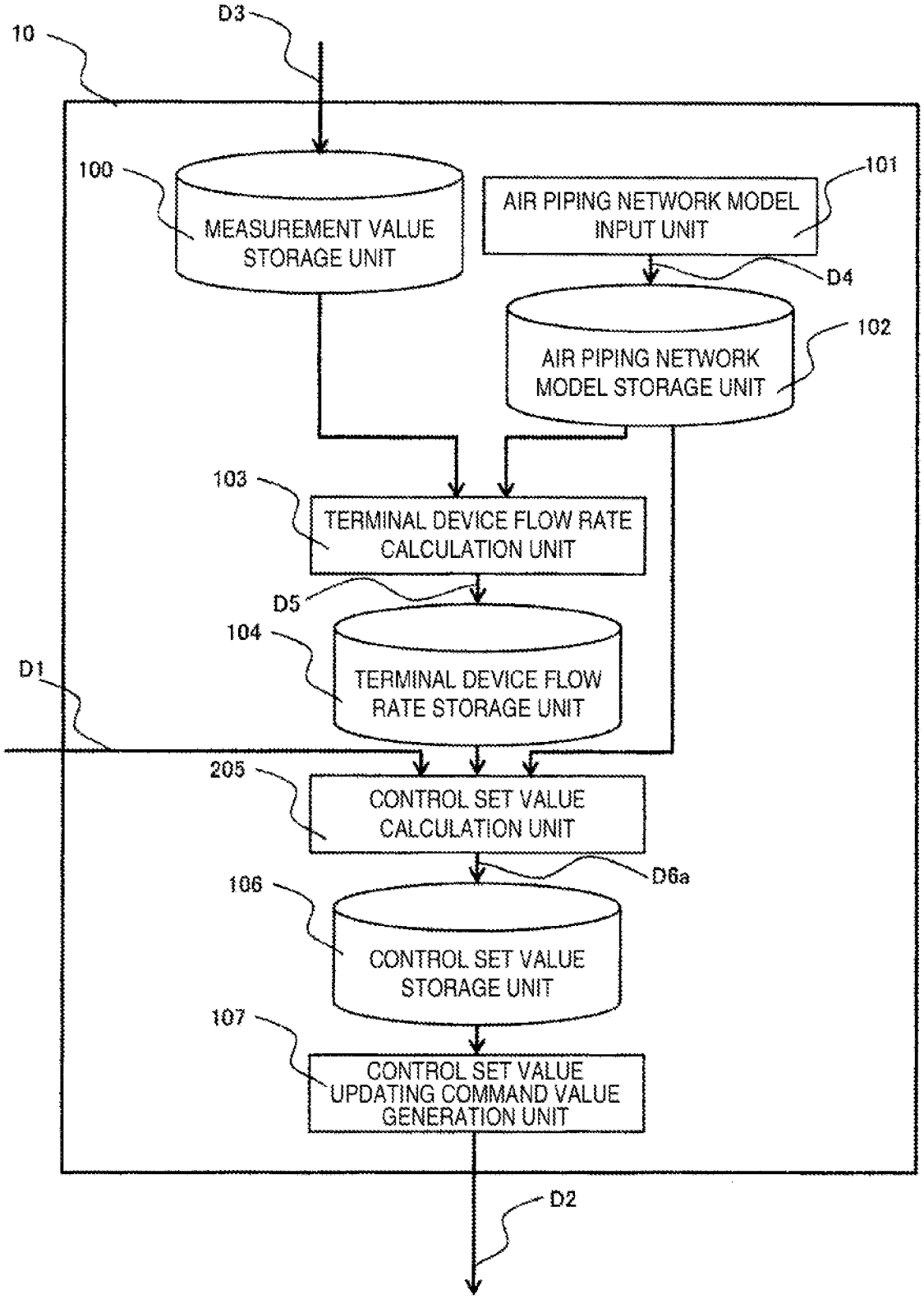
FIG. 9 is a schematic configuration view of a control set value updating unit according to a second embodiment.

FIG. 9 is a schematic configuration view of the control set value updating unit 10 according to the second embodiment.

Parts same as those in the first embodiment are denoted by the same reference numerals as used in the previous drawings, and the description thereof will be omitted.

The difference from the first embodiment is that the set value of the supply pressure to the terminal device is also updated in the process of updating the control set value. Specifically, the pneumatic system operation control device according to the present embodiment includes a control set value calculation unit 205 instead of the control set value calculation unit 105.

The control set value calculation unit 205 calculates the control set value and the set value of the supply pressure to the terminal device so that the supply pressure value decreases while suppressing the fluctuations in the supply pressure to the terminal device using the control set value D1, the air piping network model D4, and the terminal device flow rate D5, adds a supply pressure set value updating value PSa to the control set value updating value D6, and outputs them as the control set value updating value D6*a*.

The above description is different from that of the first embodiment, and the description of the other points is the same as that of the first embodiment.

Figure 10:
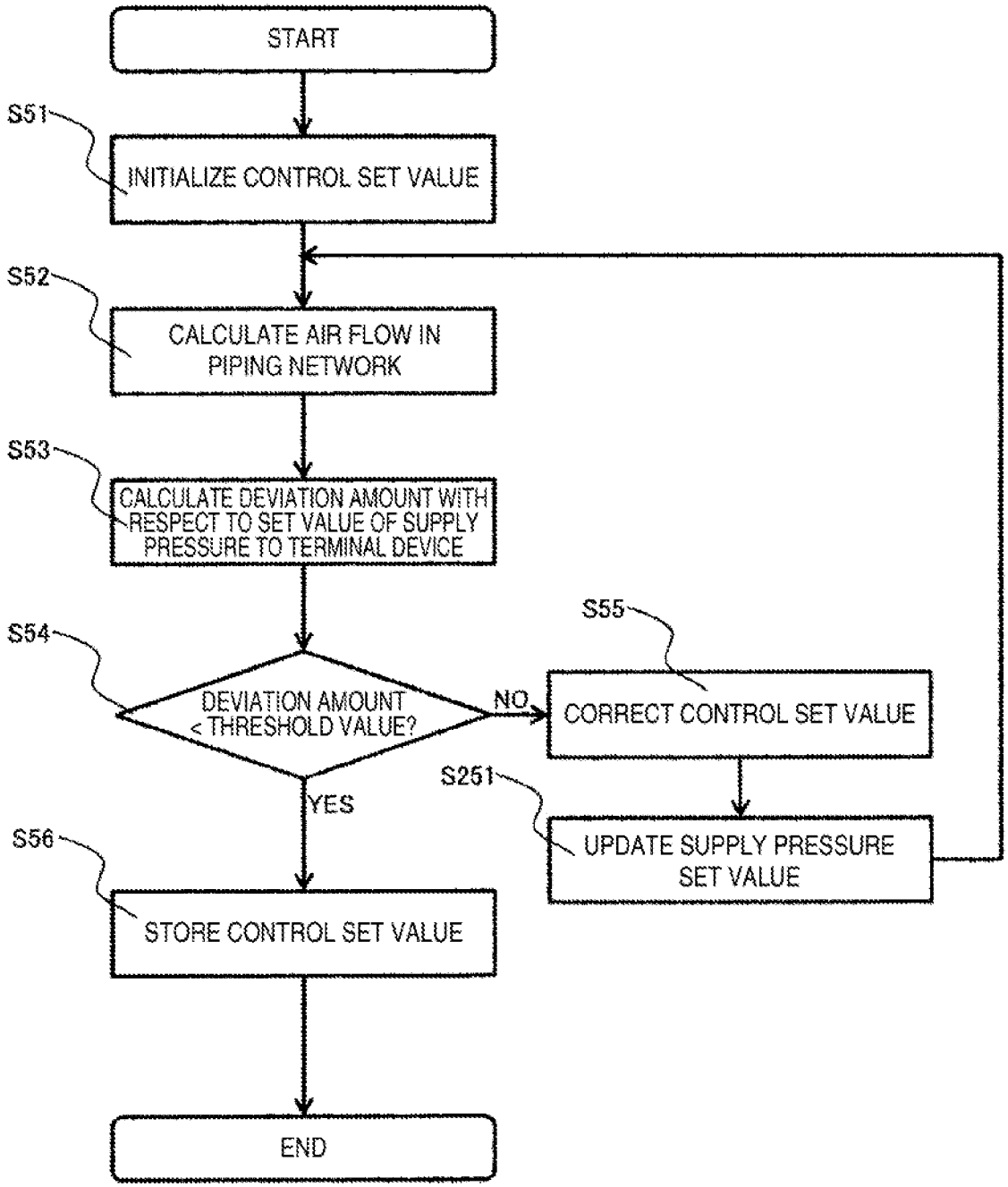
FIG. 10 is a detailed flowchart of a control set value calculation process according to the second embodiment.

Next, the content of the process performed by the control set value updating unit 10 will be described in detail. FIG. 10 shows the detailed procedure of the process of step S5 (control set value calculation process) according to the second embodiment. Parts same as those in the first embodiment are denoted by the same reference numerals as used in the previous drawings, and the description thereof will be omitted.

The processing procedure of the present embodiment is different from the processing procedure of the first embodiment in that the process of S251 is included after step S55 (control set value correction process).

Figure 11:
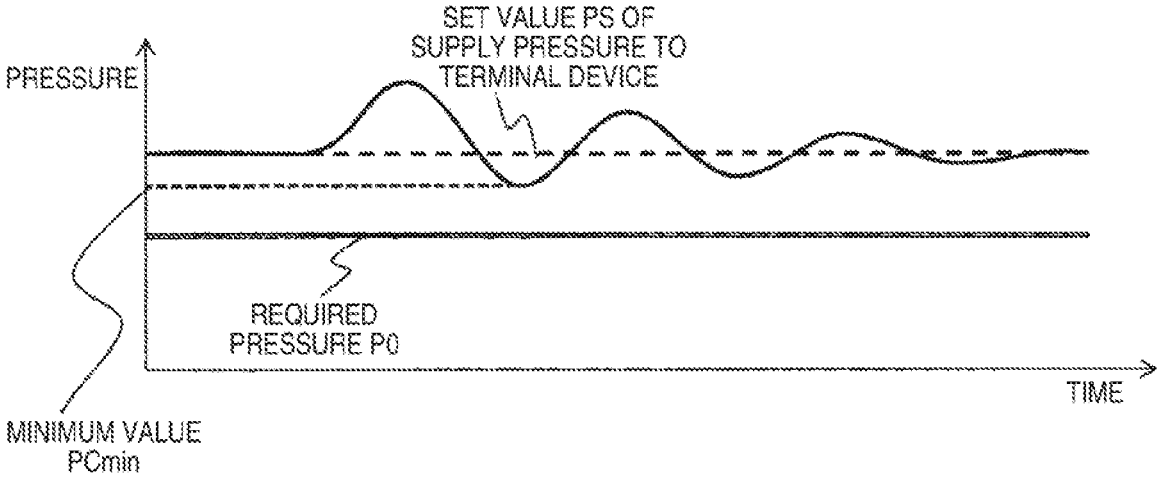
FIG. 11 is a diagram showing the relations between a set value of a supply pressure to the terminal device, a required pressure, and the minimum value of the terminal unit supply pressure calculation value according to the second embodiment.

In step S251 (update process of the supply pressure set value), the control set value calculation unit 205 updates the set value PS of the supply pressure to the terminal device so that the set value PS of the supply pressure to the terminal device becomes the minimum within the range where the terminal device supply pressure is equal to or higher than the required pressure P0. Specifically, as shown in FIG. 11, the supply pressure set value updating value PSa is calculated from the following expression where PCmin is the minimum value of the calculation value PC of the supply pressure to the terminal device, and P0 is the required pressure.

$$PSa=PS-(PC\text{min}-P0) \quad \text{(Equation 2)}$$

Figure 12:
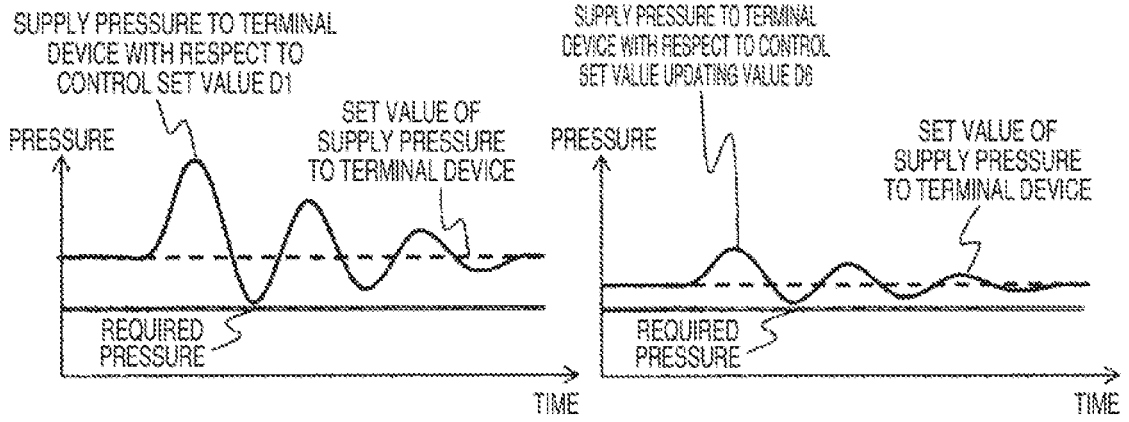
FIG. 12 is a diagram in which a supply pressure to the terminal device with respect to a control set value and a supply pressure to the terminal device with respect to a control set value updating value according to the second embodiment are compared.

FIG. 12 is a diagram in which the supply pressure to the terminal device with respect to the control set value D1 and the supply pressure to the terminal device with respect to the control set value updating value D6*a* are compared. The control set value calculation unit 205 updates the set value PS of the supply pressure to the terminal device so as to decrease the supply pressure value as well as to suppress the fluctuations in the supply pressure to the terminal device. As a result, the value of the supply pressure to the terminal device to the control set value updating value D6*a* is lower than the value of the supply pressure to the terminal device to the control set value D1. The decrease in the supply pressure to the terminal device allows the discharge pressure of the air compressor to also be decreased, and the power consumption of the air compressor can be reduced.

The processing procedure of this embodiment mentioned above is different from that of the first embodiment, and the procedure of the other points is the same as that of the first embodiment.

As described above, in the present embodiment, in addition to the respective effects which the first embodiment has, the power consumption of the air compressor can be reduced by updating the set value of the supply pressure such that the supply pressure value decreases.

Third Embodiment

Figure 13:
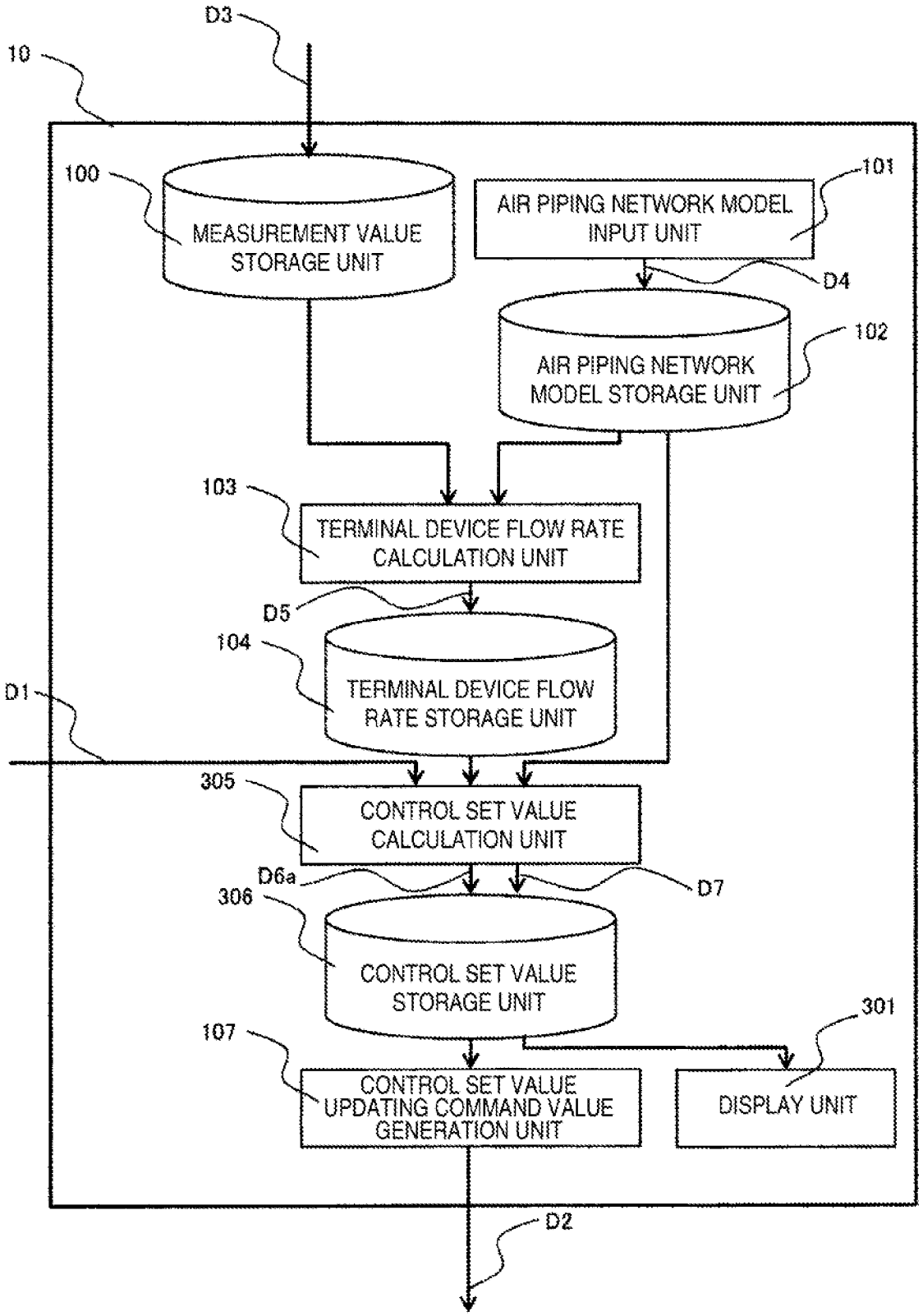
FIG. 13 is a schematic configuration view of a control set value updating unit according to a third embodiment.

FIG. 13 is a schematic configuration view of the control set value updating unit 10 according to the third embodiment. Parts same as those in the third embodiment are denoted by the same reference numerals as used in the previous drawings, and the description thereof will be omitted.

The difference from the second embodiment is that for the conditions before and after the update of the control set value, the fluctuations in the supply pressure to the terminal device and an air compressor power consumption value are displayed on the display device. Specifically, the pneumatic system operation control device according to the present embodiment includes a control set value calculation unit 305, a control set value storage unit 306, and a display unit 301 instead of the control set value calculation unit 205 and the control set value storage unit 106.

The control set value calculation unit 305 calculates the control set value and the set value of the supply pressure to the terminal device so that the supply pressure value decreases while suppressing the fluctuations in the supply pressure to the terminal device using the control set value D1, the air piping network model D4, and the terminal device flow rate D5, and outputs them as the control set value updating value D6*a*. Furthermore, it outputs a piping network flow calculation result D7 for the control set value D1 and the control set value updating value D6*a*.

The control set value storage unit 306 includes a memory and a hard disk, and stores the control set value updating value D6*a*, and the piping network flow calculation result D7 which are output by the control set value calculation unit 305.

The display unit 301 includes a display device (display) and displays on the display device the fluctuations in the supply pressure to the terminal device with respect to the control set value D1 and the control set value updating value D6*a*, and the air compressor power consumption value using the piping network flow calculation result D7.

The above description is different from that of the second embodiment, and the other points are the same as that of the second embodiment.

Figure 14:
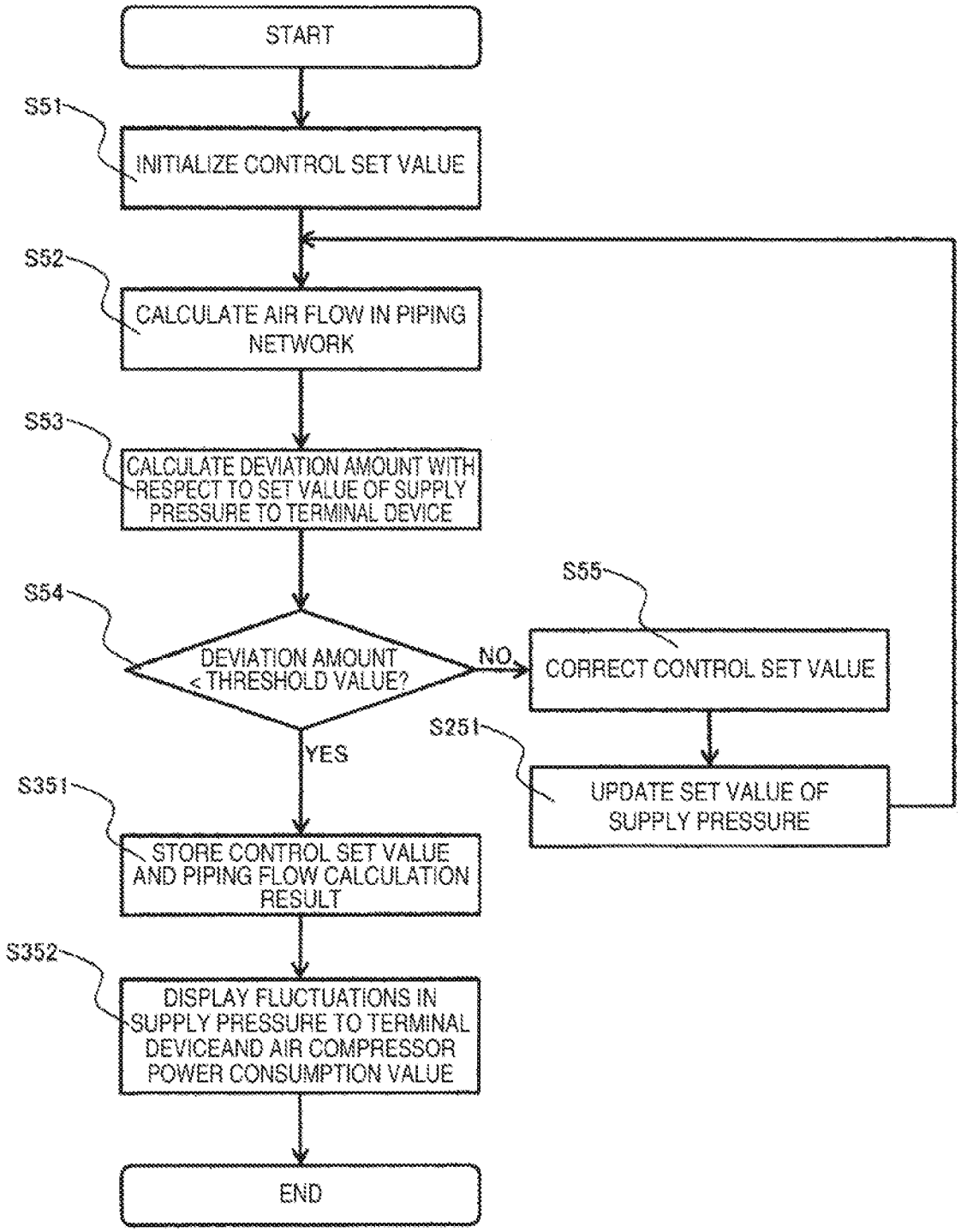
FIG. 14 is a detailed flowchart of a control set value calculation process according to the third embodiment.

Next, the content of the process performed by the control set value updating unit 10 will be described in detail. FIG. 14 shows the detailed procedure of the process of step S5 (control set value calculation process) according to the third embodiment. Parts same as those in the second embodiment are denoted by the same reference numerals as used in the previous drawings, and the description thereof will be omitted.

The processing procedure of the present embodiment is different from the processing procedure of the second embodiment in that the processes of S351 and S352 are included instead of step S56.

In step S351 (control set value storage process and pipeline flow calculation result storing process), the control set value calculation unit 305 outputs the control set value updating value D6*a* and the piping network flow calculation result D7, which are stored in the memory and the hard disk of the control set value storage unit 306.

Figure 15:
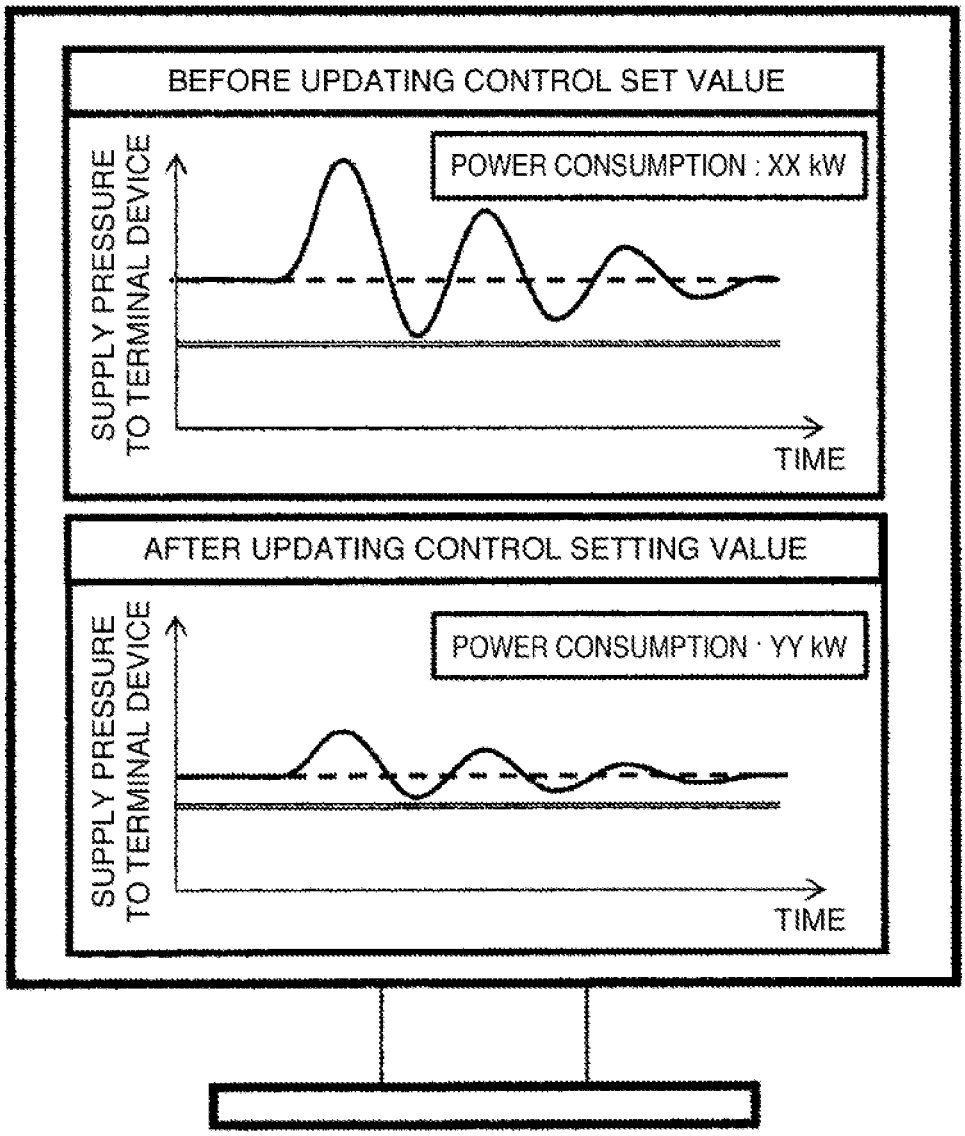
FIG. 15 is a diagram showing on the display device fluctuations in the supply pressure to the terminal device and the air compressor power consumption value with respect to the control set value and the control set value updating value according to the third embodiment.

In step S352 (pressure fluctuation display process and power consumption display process), the display unit 301 displays on the display device the fluctuations of the supply pressure to the terminal device with respect to the control set value D1 and the control set value updating value D6*a*, and the air compressor power consumption value using the piping network flow calculation result D7. FIG. 15 shows a display sample of the fluctuations in the supply pressure to the terminal device and the air compressor power consumption value with respect to the set value D1 and the control set value updating value D6*a*. The fluctuations in the supply pressure to the terminal device and the air compressor power consumption value with respect to the control set value D1 are displayed on the upper side of the display screen. The fluctuations in the supply pressure to the terminal device and the air compressor power consumption value with respect to the control set value updating value D6*a* are displayed on the lower side of the display screen. As an alternative to the display example shown in FIG. 15, the fluctuations in the supply pressure to the terminal device alone or the air compressor power consumption value alone may be displayed.

The processing procedure of this embodiment mentioned above is different from that of the second embodiment, and the procedure of the other points is the same as that of the second embodiment.

As described above, in addition to the respective effects which the second embodiment has, the fluctuations in the supply pressure to the terminal device and the air compressor power consumption value for the conditions before and after the update of the control set value are displayed on the display device, whereby facility managers of pneumatic systems can make sure of effect on suppression of the pressure fluctuations in terminal devices and the effect of reducing the power consumption of the air compressor.

The above embodiments of the present invention describe an embodiment in which the fluid flowing in the piping network is the compressed air compressed by the air compressor has been described. However, the present invention is not limited thereto, and embodiments may be provided in which steam, water, air for air conditioning, oil for hydraulic pressure, or the like flows in the piping network.

REFERENCE SIGNS LIST

1 air compressor unit
2 air compressor main body
3 air compressor discharge portion pressure sensor
4 control device
5 variable speed device
6 electric motor
7 air piping network
8 terminal device
9 terminal device pressure sensor
10 control set value updating unit
100 measurement value storage unit
101 air piping network model input unit
102 air piping network model storage unit
103 terminal device flow rate calculation unit
104 terminal device flow rate storage unit
105, 205, 305 control set value calculation unit
106, 306 control set value storage unit
107 control set value updating command value generation unit
301 display unit

The invention claimed is:

1. A pneumatic system operation control device that variably controls a rotational speed of an electric motor for driving an air compressor so that a supply pressure to a terminal device becomes constant using a measurement value of a discharge pressure of the air compressor and a measurement value of the supply pressure to the terminal device, the pneumatic system operation control device comprising:

a measurement value storage unit that stores the discharge pressure measurement value and the supply pressure measurement value;

an air piping network model input unit that receives an air piping network model composed of data for calculating air flow in an air piping network, the air piping network being a path for supplying compressed air from the air compressor to the terminal device;

an air piping network model storage unit that stores the air piping network model;

a terminal device flow rate calculation unit that calculates an air flow rate supplied to the terminal device using the discharge pressure measurement value, the supply pressure measurement value, and the air piping network model;

a terminal device flow rate storage unit that stores the air flow rate;

a control set value calculation unit that calculates an updating value for a control set value using a control set value for variably controlling the rotational speed of the electric motor for driving the air compressor, the air flow rate and the air piping network model;

a control set value storage unit that stores the updating value, and a control set value updating command value generation unit that generates a command value for updating a control set value for variably controlling the rotational speed of the electric motor for driving the air compressor using the updating value.

2. The pneumatic system operation control device according to claim 1, wherein the control set value calculation unit calculates the updating value for the control set value and an updating value for a set value of the supply pressure to the terminal device.

3. The pneumatic system operation control device according to claim 1, wherein the control set value calculation unit outputs an air flow calculation result in the air piping network with a condition before and after the control set value is updated, the control set value storage unit stores the air flow calculation result, and the pneumatic system operation control device includes a display unit for displaying pressure fluctuations at the terminal device or a power consumption of the air compressor from the air flow calculation result with the condition before and after the control set value is updated.

4. A pneumatic system operation control method using the pneumatic system operation control device according to claim 1, wherein calculating the updating value for the control set value includes outputting an air flow calculation result in the air piping network with a condition before and after the control set value is updated, storing the updating value includes storing the air flow calculation result, and the pneumatic system operation control method includes displaying pressure fluctuations at the terminal device or a power consumption of the air compressor from the air flow calculation result with the condition before and after the control set value is updated.

5. A pneumatic system operation control method of variably controlling a rotational speed of an electric motor for driving an air compressor so that a supply pressure to a terminal device becomes constant using a measurement value of a discharge pressure of the air compressor and a measurement value of a supply pressure to the terminal device, the pneumatic system operation control method comprising:

storing the discharge pressure measurement value and the supply pressure measurement value;

receiving an air piping network model composed of data for calculating air flow in an air piping network, the air piping network being a path for supplying compressed air from the air compressor to the terminal device;

storing the air piping network model;

calculating an air flow rate supplied to the terminal device using the discharge pressure measurement value, the supply pressure measurement value, and the air piping network model;

storing the air flow rate;

calculating an updating value for a control set value using the control set value for variably controlling the rotational speed of the electric motor for driving the air compressor, the air flow rate, and the air piping network model;

storing the updating value; and updating the control set value for variably controlling the rotational speed of the electric motor for driving the air compressor using the updating value.

6. The pneumatic system operation control method according to claim 5, wherein calculating the updating value for the control set value includes calculating the updating value for the control set value and an updating value for a set value for the supply pressure to the terminal device.

* * * * *